US012098850B2

(12) United States Patent
Hirschmann et al.

(10) Patent No.: US 12,098,850 B2
(45) Date of Patent: Sep. 24, 2024

(54) SLIDE-TYPE RANGE HOOD

(71) Applicant: Oy Halton Group Ltd., Helsinki (FI)

(72) Inventors: Christian Hirschmann, Kuala Lumpur (MY); Jouni Ryynänen, Kotka (FI); Chun Khai Tan, Kuala Lumpur (MY)

(73) Assignee: Oy Halton Group Ltd., Helsinki (FI)

( * ) Notice: Subject to any disclaimer, the term of this patent is extended or adjusted under 35 U.S.C. 154(b) by 443 days.

(21) Appl. No.: 17/599,789

(22) PCT Filed: Apr. 3, 2020

(86) PCT No.: PCT/US2020/026546
§ 371 (c)(1),
(2) Date: Sep. 29, 2021

(87) PCT Pub. No.: WO2020/206227
PCT Pub. Date: Oct. 8, 2020

(65) Prior Publication Data

US 2022/0136708 A1 May 5, 2022

Related U.S. Application Data

(60) Provisional application No. 62/829,218, filed on Apr. 4, 2019.

(51) Int. Cl.
*F24C 15/20* (2006.01)

(52) U.S. Cl.
CPC ..... *F24C 15/2092* (2013.01); *F24C 15/2028* (2013.01)

(58) Field of Classification Search
CPC .. F24C 15/2092; F24C 15/2028; B08B 15/02; B08B 15/023
See application file for complete search history.

(56) References Cited

U.S. PATENT DOCUMENTS 3,583,306 A * 6/1971 Hagdorn ..... F24C 15/2028 219/400
3,785,124 A 1/1974 Gaylord
(Continued)

FOREIGN PATENT DOCUMENTS

CN 101070973 A 11/2007
CN 102563733 7/2012
(Continued)

OTHER PUBLICATIONS

Office Action dated Apr. 28, 2023 for Singaporean Patent Application No. 11202110397P.
(Continued)

*Primary Examiner* — Edelmira Bosques
*Assistant Examiner* — Michael James Giordano
(74) *Attorney, Agent, or Firm* — Potomac Law Group, PLLC

(57) ABSTRACT

An exhaust device has a fan plenum with a fan and a jet plenum having a generally planar shape with one or more jet openings on a distal end thereof configured to create a planar jet. The jet plenum is movably attached at a proximal end thereof to the fan plenum to permit sliding movement of the jet plenum relative to the fan plenum. The fan plenum and the jet plenum each have a respective flow-transfer opening that overlaps the opening of the other, the respective openings being shaped and arranged to remain overlapped in all positions to which the jet plenum is moved relative to the fan plenum such that an interior of the fan plenum and the jet plenum remain in fluid communication to allow air to flow from the fan to flow from the fan plenum to the jet plenum.

19 Claims, 14 Drawing Sheets

(56) References Cited

U.S. PATENT DOCUMENTS

| | | | | |
|---|---|---|---|---|
| 3,805,685 | A | 4/1974 | Carns | |
| 7,959,696 | B2 | 6/2011 | Martic et al. | |
| 9,494,324 | B2 | 11/2016 | Livchak et al. | |
| 2005/0092745 | A1 | 5/2005 | Yim et al. | |
| 2006/0278215 | A1 | 12/2006 | Gagas et al. | |
| 2006/0278216 | A1 | 12/2006 | Gagas et al. | |
| 2009/0264060 | A1 | 10/2009 | Livchak et al. | |
| 2011/0094497 | A1 | 4/2011 | Schrock et al. | |
| 2020/0191410 | A1 * | 6/2020 | Scalf | F24C 15/2085 |

FOREIGN PATENT DOCUMENTS

| | | | | | |
|---|---|---|---|---|---|
| CN | 102563733 | A | * | 7/2012 | |
| CN | 102767876 | A | | 11/2014 | |
| CN | 206073205 | U | | 4/2017 | |
| CN | 207019129 | U | | 2/2018 | |
| CN | 108087332 | A | | 5/2018 | |
| CN | 108194954 | A | | 6/2018 | |
| CN | 109268893 | A | * | 1/2019 | F24C 15/2021 |
| CO | 7101221 | A2 | | 10/2014 | |
| DE | 2737822 | A1 | | 3/1979 | |
| DE | 3144777 | A1 | | 5/1983 | |
| DE | 102010042436 | A1 | | 4/2012 | |
| EP | 1944553 | A2 | | 11/2010 | |
| EP | 2594852 | A1 | | 5/2013 | |
| EP | 2857759 | A1 | | 4/2015 | |
| EP | 3088080 | A1 | | 4/2018 | |
| EP | 3117152 | A1 | | 11/2019 | |
| ES | 2267578 | T3 | | 3/2007 | |
| JP | H03255837 | A | | 11/1991 | |
| JP | 2000081216 | A | | 3/2000 | |
| JP | 2002168496 | A | | 6/2002 | |
| JP | 2007192482 | A | * | 8/2007 | |
| JP | 2007192483 | A | | 8/2007 | |
| JP | 2001084039 | A | | 9/2007 | |
| JP | 2001355889 | A | | 6/2008 | |
| WO | 2006009348 | A1 | | 1/2006 | |

OTHER PUBLICATIONS

International Search Report and Written Opinion mailed Sep. 14, 2020 for International Patent Application No. PCT/US2020/026546.

Invitation to Pay Additional Fees mailed Jul. 23, 2020 for International Patent Application No. PCT/US2020/026546.

Office Action (Communication Pursuant to Article 94(3) EPC) dated Feb. 7, 2023 for European Patent Application No. 20723615.9.

Office Action (First) dated Nov. 3, 2023 for Taiwanese Patent Application No. 109111523.

Office Action (Notice of Reasons for Refusal) mailed Nov. 21, 2023 for Japanese Patent Application No. 2021-557098.

Office Action dated Jan. 11, 2024 for Colombian Patent Application No. NC2021/0013024.

* cited by examiner

SLIDE-TYPE RANGE HOOD

CROSS-REFERENCE TO RELATED APPLICATIONS

This Application is a U.S. national stage filing under 35 U.S.C. § 371 of International Application No. PCT/US2020/026546, filed Apr. 3, 2020, which claims priority to and the benefit of U.S. Provisional Patent Application No. 62/829,218 filed Apr. 4, 2019, both of which are hereby incorporated by reference in their entireties.

BACKGROUND

Exhaust hoods for ventilation of pollutants from kitchen appliances, such as ranges, promote capture and containment, that is, full assurance that all pollutants from cooking are captured and exhausted from the kitchen thereby preventing pollution of an adjacent occupied zone. In large commercial kitchens such a function is provided by a tall hood with a large interior void which helps to smooth the fluctuations in fumes. Such hoods tend to be large and tall obstructing the view across the kitchen. Hoods also generally need to draw a great deal of room air in order to ensure that all fumes are captured. Without the interior void it is difficult to ensure full capture and containment without drawing a large volume of air from the room.

Basic exhaust hoods use an exhaust blower to create a negative pressure zone to draw effluent-laden air directly away from the pollutant source. In kitchen hoods, the exhaust blower generally draws pollutants, including room-air, through a filter and out of the kitchen through a duct system. An exhaust blower, e.g., a variable speed fan, contained within the exhaust hood is used to remove the effluent from the room and is typically positioned on the suction side of a filter disposed between the pollutant source and the blower. Depending on the rate by which the effluent is created and the buildup of effluent near the pollutant source, the speed of exhaust blower may be set to minimize the flow rate at the lowest point which achieves capture and containment.

SUMMARY

An exhaust hood employs a shallow jet plenum that functions as a low hood that can be repositioned, in embodiments to optimize its overhang for each application, and in embodiments as the need arises. For example, the position of the jet plenum may be changed by an installer during installation of a hood module. In other embodiments, the jet plenum position may be changed to suit a particular appliance that is placed under the hood. In still other embodiments, the jet plenum position may be changed by a cook to permit the cook to view cooking food. The jet plenum position may also be changed automatically by means of a control system.

In embodiments with a control system, the existing positioning of the jet plenum may be done a cook after being initially established by the installer.

The system may include a horizontally-movable side barrier or skirt.

The system may be modular in that a cooking line can be formed with multiple exhaust units each with its own jet plenums side by side with each jet plenum being positionable independently of others in the same cooking line.

For example, a cook may have difficulty seeing food cooking on a particular cooking appliance, such as a grill or a pot, may move only the jet plenum immediately above that particular appliance. In such instances, the cook may retract a single jet plenum. In embodiments, the movement of the jet plenums is controlled automatically by a sensor system that can detect an appliance status such as off, idle, and cooking. See for example, U.S. Pat. No. 9,494,324 which discloses an apparatus that can detect an appliance state using infrared and sensible temperature sensors.

The disclosed system may control the position of the jet plenum responsively to input from such a system. For example, the jet plenum may be retracted when the appliance is off. The jet plenum may be extended partially when the appliance is idle and it may be fully extended when the appliance cooking state is detected. In embodiments, the cook may have override control over any action such an automated system may take. That is, the cook may be provided with a user interface, for example using push-buttons or manually pushing the jet plenum to control the position of the jet plenum to override the control system command.

Objects and advantages of embodiments of the disclosed subject matter will become apparent from the following description when considered in conjunction with the accompanying drawings.

BRIEF DESCRIPTION OF THE DRAWINGS

Embodiments will hereinafter be described in detail below with reference to the accompanying drawings, wherein like reference numerals represent like elements. The accompanying drawings have not necessarily been drawn to scale. Where applicable, some features may not be illustrated to assist in the description of underlying features.

DETAILED DESCRIPTION

Figure 1A:
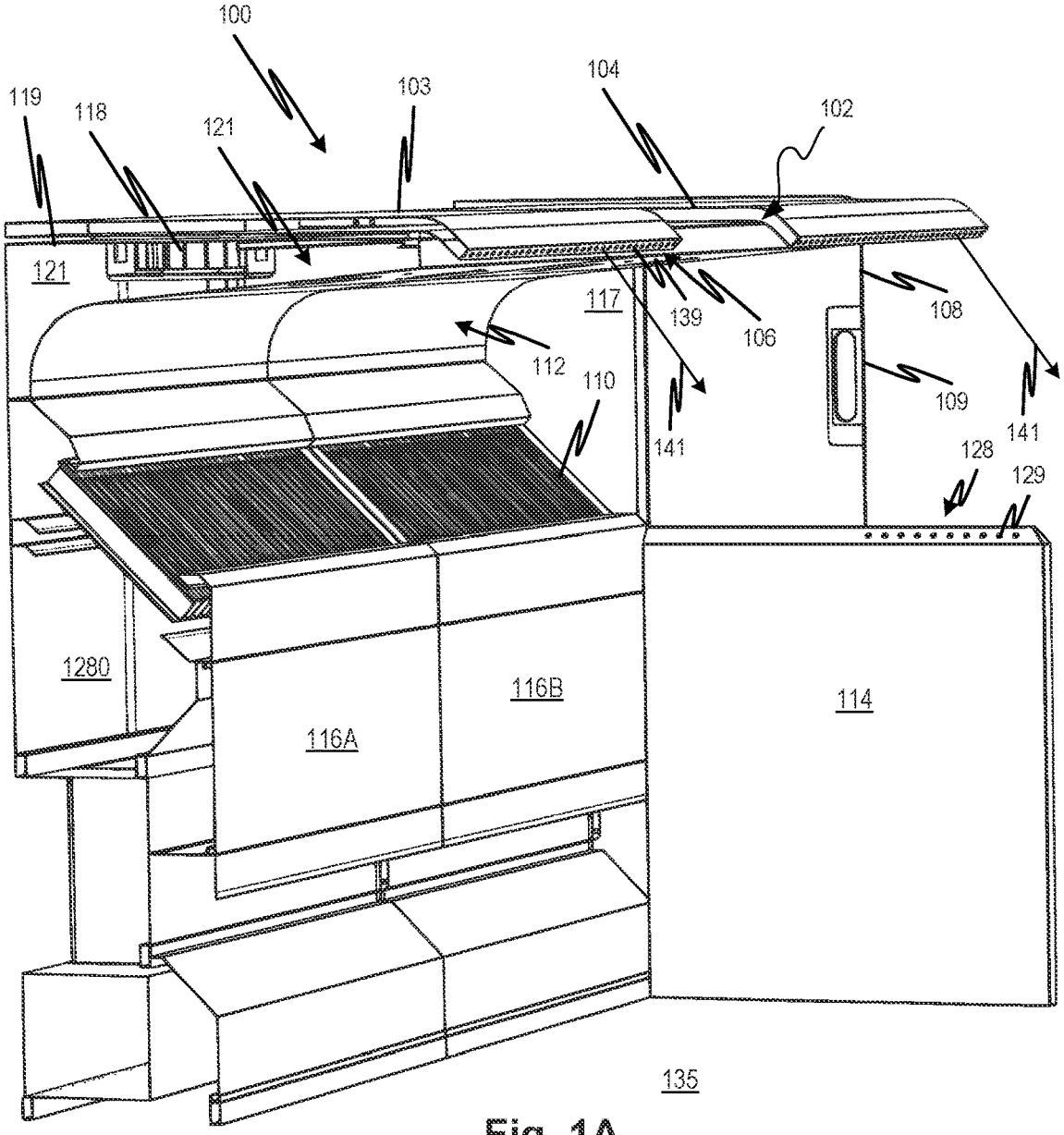
FIG. 1A shows a sectioned oblique view of an exhaust device with two modules having two movable jet plenums that function as miniature hoods in retracted and extended positions.

FIG. 1A shows a sectioned oblique view of an exhaust system 100 with two exhaust modules 116A and 116B having two movable jet plenums 103 and 104 respectively that function, together with attached fan plenums 119 as miniature hoods that can be retracted and extended. A jet fan 118 is housed in a fan plenum 119. The fan plenum 119 remains fixed relative to the housing of exhaust module 116A that encloses an exhaust duct 1280. The exhaust module 116A is one of two exhaust modules 116A and 116B shown adjacent each other. Cooking appliances are placed between end panels 114, only one of which is shown. Each end panel 114 may enclose a plenum to feed air to a jet generator 128 here shown as a series of holes 129 that emit jets that coalesce to form a planar jet a small distance from the jet generator 128. The end panel 114 may have its own jet fan (not shown) located on a side opposite the view of FIG. 1 drawing to supply air to the jet generator 128. The jet(s) emitted by jet generator 128 may aim horizontally upward, or be directed diagonally upward, and may intersect the jet(s) emitted from jet generators of the jet plenum 104.

Jets are high velocity, low-mass streams of air that are discharged as an initial stream from a jet generator (e.g., jet generator 128 above, with a series of holes 129) into a surrounding mass of air to impart momentum to the surrounding air without adding significantly to the mass of the surrounding air. The function of the jet is the transfer of momentum, not the introduction of an outside substance (e.g., make-up air) and thereby adding mass into the surrounding space. As the initial stream is discharged at high velocity, it mixes with surrounding air and imparts its momentum to the surrounding air, thereby forming a planar jet that is made up principally of the surrounding mass of air. The mass of the initial stream contributes only a very small percentage to the total mass of the jet.

An exhaust fan (not shown) is connected through duct (not shown) in the floor 135 to create a negative pressure in the exhaust duct 1280 plenum, causing fumes to be drawn through grease filters 110. The fumes drawn in through the grease filters 110 are conveyed through the plenum of exhaust duct 1280 to a treatment system (not shown) or may be exhausted to the outside of a building through the duct in the floor.

The jet fan 118 pressurizes an interior volume 121 of the fan plenum 119, which is fluidly connected to one of the jet plenums 103. The same configuration exists to pressurize the interior of the jet plenum 104. The jet plenum 103 has a jet generator 106 which is illustrated here as a series of holes 139 which emit jets that coalesce to form a planar jet that is aimed diagonally downwardly in the direction of the arrow 141. The configuration is the same for jet plenum 104. The jet generator 106 or the jet generator 128 may be embodied in the form of a slot rather than a series of holes in alternative embodiments so as to form a planar jet in a similar manner as an array of holes. As shown, holes 139 of jet generator 106 are aimed diagonally downwardly so that when the jet plenums 103 and 104 are positioned suitably, the jets that they emit may approximately intersect the outer edge of a cooking appliance positioned underneath the respective jet plenum. The cooking appliance is not shown in the drawing but they may have different depths such that repositioning of the jet plenums 103 and 104 may direct the jets as indicated. Further, a deeper appliance extending further out will be better covered by a more extended jet plenum. The interior volume of the fan plenum 119 is indicated at 121 and will be observed to extend proximally to a high section and distally to a narrower section as it tapers in the distal direction forming a curved surface 112.

Figure 1B:
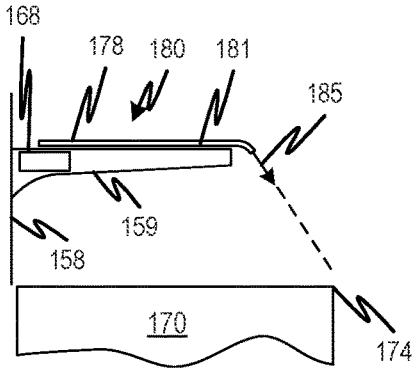
FIGS. 1B and 1C show figurative illustrations of fan and jet plenums forming shallow and deep hoods respectively according to embodiments of the disclosed subject matter.
Figure 1C:
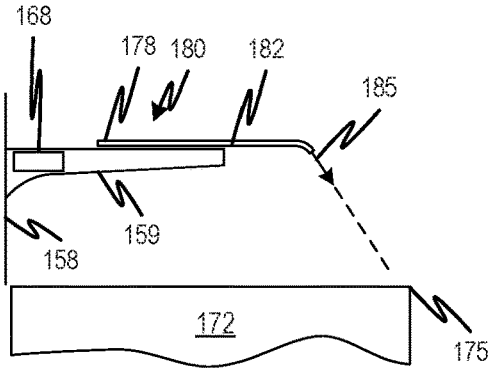

FIGS. 1B and 1C show a more figurative representation of the combinations of fan plenum 159 and jet plenum 103 and how they cooperate to form, effectively, a single hood 180 that can be extended or retracted. The fan plenum 159 encloses a fan 168 which pressurizes the fan plenum 159. The fan plenum 159 remains in single position and the jet plenum 103 is extended or retracted for example by moving it from the position indicated at 181 to the position indicated at 182. A shallow appliance 170 has a smaller depth and the jet plenum 178 is shown in a retracted position 181 such that its jet 185 may be better aimed to intersect with an outer edge 174 of the shallow appliance 170. A deeper appliance 172 has a larger depth and the jet plenum 178 is shown in an extended position 182 such that its jet 185 may be better aimed to intersect with an outer edge 175 of the deeper appliance 172. It will be observed that in cooperation with a back wall 158 of the exhaust module, the fan plenum 159 together with the jet plenum 178 cooperate in both conditions to act as a hood with a low depth (FIG. 1B) and a greater depth (FIG. 1C) thereby serving to capture fumes from appliances of shallow depth 170 and greater depth 172. It will be understood that this functionality can be provided in jet plenum 104, and any other jet plenums that may be present in any particular implementation.

Referring again to FIG. 1A, the jet plenum 103 and 104 each has a curved end 102 that helps to guide air along its surface to feed an emitted jet from the jet generator 106. A second jet plenum 104 is shown adjacent the jet plenum 103.

The jet plenum 103 is movably attached to the exhaust module 116A and the jet plenum 104 is movably attached to the exhaust module 116B. It will be understood that although the arrow 141 is indicated as a single narrow jet, the collection of jets from all the holes 139 of the jet generator 106 will coalesce to form a planar jet.

Each exhaust module 116A and 116B may be of substantially the same configuration. The jet plenum 103, 104 of each may be set in a position responsively to a type and size of cooking appliance. The repositioning of the jet plenum 103, 104 may be done at various time according to different embodiments. For example, jet plenum 103, 104 position may be established or adjusted by an installer of an appliance, in embodiments. In further embodiments, the jet plenum 103, 104 position may be established or adjusted by a cook that is using the appliance. In further embodiments the jet plenum 103, 104 may be positioned automatically according to cooking state data received by a controller of a motor drive that controls the position of the jet plenum.

A horizontally movable side skirt 108, which may be opaque or clear, can be adjusted horizontally by means of a handle 109 integrated into it. A portion of the movable side skirt is hidden and slides out from inside a panel 117.

Figure 2:
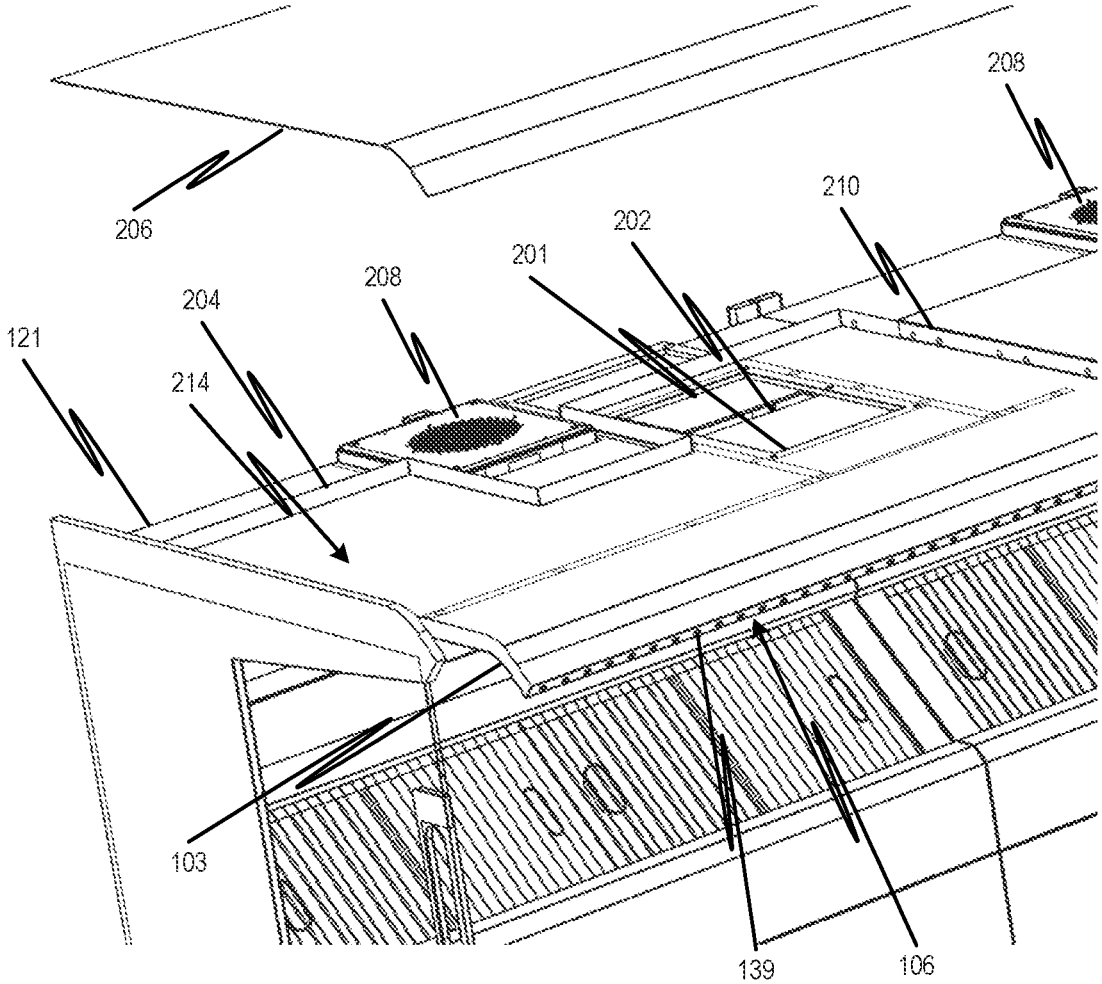
FIG. 2 shows portions of the inside of the jet plenum to illustrate how air from a fan pressurizes the movable jet plenum according to embodiments of the disclosed subject matter.

FIG. 2 shows portions of the inside of the jet plenum 103 (with its top 206 lifted out of its normal position) to illustrate how air from a fan (below the inlet grill 208 but not visible in the present drawing) pressurizes the movable jet plenum 103. The interior of the fan plenum 119 which lies below the housing of the fan plenum visible at 121 is pressurized by the fan 118 (See FIG. 1A). The fan 118 lies below and is connected to, an air inlet grill 208. In FIG. 2, the top 206 of the jet plenum 103 is pulled away to reveal the jet plenum 103 interior volume 214 which is fully enclosed when the top 206 is in place except for an opening 201 that receives air through the narrow slot 202. The narrow slot is in fluid communication with the interior of the fan plenum 119 so that air drawn through the inlet grill 208 flows into the fan plenum and up through the slot 202 into the interior volume 214 to cause air to be emitted from the jet generator 106. The opening 201 is substantially larger than the slot 202 slow that when the jet plenum 103 is moved, the slot 202 and the opening 201 remain overlapped and air can flow from the pressurized fan plenum 119 into the jet plenum 103 interior volume 214. Panels 204 and 210 indicate portions the define the outside edges of the jet plenum 103. Only portions are indicated but it can be seen that the panels circumnavigate the jet plenum 103 interior volume 214 to enclose it fully when the top 206 is attached. Note that the top 206 would be a part of the jet plenum and is shown separated from remainder of the jet plenum for illustration purposes only.

Figure 3:
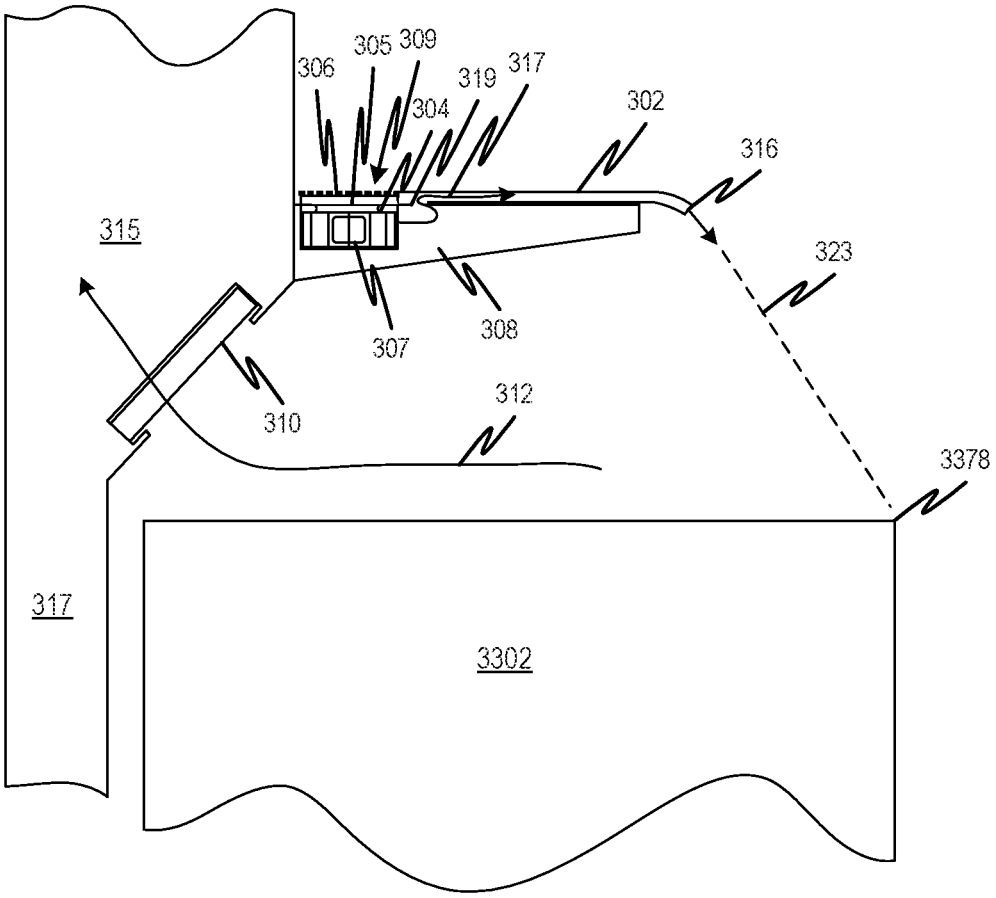
FIG. 3 shows a configuration in which the exhaust inlet and grease filter are forwardly tilted illustrating advantages from a footprint point of view according to embodiments of the disclosed subject matter.

FIG. 3 shows a configuration in which the exhaust inlet and grease filter 310 are forwardly tilted to illustrate advantages of the arrangement in terms of the overall depth of the exhaust module and appliance from the viewpoint of overall footprint. An appliance 3302 is positioned beneath a fan plenum 308 with a movably connected jet plenum 302. The jet plenum 302, as discussed above, may be moved relative to the fan plenum 308. A curved arrow illustrates how air from the fan plenum 308 passes through a slot 319 to enter the jet plenum 302 to pressurize and thereby form diagonal planar jet from the jet generator 316. The configuration shares common elements with the embodiments of FIGS. 1A and 2 particularly the form and arrangement of the fan plenum 308 and the jet plenum 302, the direction of the jet and the aiming of the planar jet 323 so that it intersects with a forward edge of the appliance 3302.

In a method of exhausting fumes, the jet plenum 302 may be moved until it achieves a position where initial direction of the planar jet 323 (as shown by the dashed line) reaches or extends beyond a distal boundary of the appliance 3302. It is understood that the planar jet 323 thereby traps the fumes below the jet plenum 302, allowing the fumes to only exit through duct section 315 (after they pass through filter 310).

The fan 304 of the fan plenum 308 draws air through a grill 306 that may be positioned in a flat top section of the jet plenum 302. The top section of the jet plenum with grill 306 openings 309 may be simply a flat plate with punched and formed openings 309 so that the top section rises minimally above a fan inlet 305. A fan motor 307 drives the jet fan 304 which may be a centrifugal blower.

Note that in embodiments, the planar jet 323 may overshoot the forward edge 3378 of the appliance 3302. For example, in embodiments, the appliance 3302 may be a front-opening device such as an oven and the optimal position of the planar jet 323 may be directed diagonally further out to help ensure the capture and containment of fumes emitted by such an open door that extends beyond the forward edge 3378.

The forward tilted grease filter 310 may allow fumes to be exhausted downwardly or upwardly according to respective embodiments. In the present figure, the fumes may be exhausted toward the ceiling through the duct section 315 and a further duct or chamber 317 reserved for supply of services such electrical, fuel, and other service conduits. It will be observed that in contrast to the configuration of FIGS. 1A and 2, there is less room required because the fume ductwork 315 is located above the appliance 3302 in contrast to being located to behind the appliance as would be the case for the configuration of FIG. 1A. Thus, the depth dimension space, or the footprint, of the combined exhaust system and appliance 3302 can be smaller since the appliance 3302 can be shifted inwardly (to the left with reference to the drawing page). In a downward-flowing configuration more room is required for the fume duct. See arrow 312 which shows the flow of fumes.

Figure 4A:
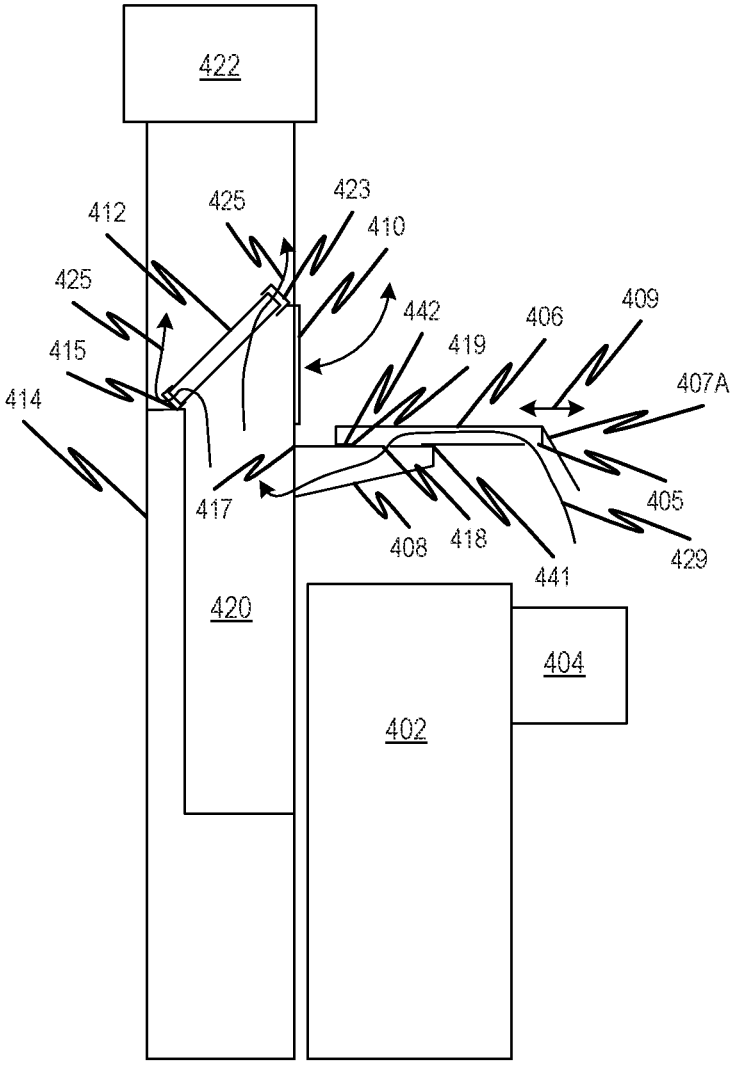
FIG. 4A shows a modular services wall with an exhaust duct, filter, and a movable suction hood according to embodiments of the disclosed subject matter.

FIG. 4A shows a modular services wall 414 with an exhaust duct 420 therewithin, a grease filter 412, and a movable suction hood 406 according to embodiments of the disclosed subject matter. In the present embodiment, instead of providing a fixed fan plenum and jet plenum, a fixed suction plenum supplies suction to a movable suction plenum in a manner that is analogous to the foregoing configurations except that the flow of a jet because a suction that is supplied to an exhaust duct and there is no separate jet fan (e.g., 304 in FIG. 3).

A modular services wall 414 may be a cabinet with an interior space for service conduits such as electrical cables, water conduits, exhaust ducts 420 and supply ducts, and other such services, not shown except for the exhaust duct 420. A movable suction plenum 406 interconnects with a fixed suction plenum 408 in a manner similar that that described with reference to FIG. 3 except that suction is applied directly to the fixed suction plenum via the interior of an exhaust duct 420 inside the modular services wall 414. Specifically, an opening 419 in the movable suction plenum 406 overlies a narrow slot 418 to provide fluid continuity between an interior of the fixed suction plenum 408 and the movable suction plenum 406 in a range of positions of the movable suction plenum 406 with respect to the fixed suction plenum 408. The arrangement operates as a single hood as illustrated with respect to the jet embodiments of FIGS. 1B and 1C. That is, the fixed suction plenum 408 and movable suction plenum 406 cooperate to act as a single hood with adjustable depth.

As will be understood, a method of exhausting fumes will include positioning appliance 402 underneath the movable suction plenum 406, generating suction in the movable suction plenum 406 (via the fixed suction plenum), and extending or retracting the movable suction plenum 406 to capture fumes from the appliance. When the appliance 402 is in an idle mode, the movable suction plenum 406 may be retracted, as the appliance will be generating at most a small amount of exhaust fumes. On the other hand, when the appliance 402 is in a cooking mode, more fumes are generated. In this situation, the movable suction plenum 406 may be extended away from duct 420 as shown by one half of arrow 409, so that a larger portion of the appliance 402 is covered by the movable suction plenum 406, thereby capturing more fumes. The method may include an automated control of the extension and retraction of the movable suction plenum 406 in response to the cooking state of the appliance. It is also possible to make this automated control based on detection of fumes escaping past the leading edge of the movable suction plenum 406. If an amount of fumes is detected as escaping, the movable suction plenum 406 may be extended by an amount. This process may be repeated until fumes no longer escape, or the amount that does escape is below some threshold amount.

A filter 412, for example a grease filter is positioned inside the duct 420 and accessible through an access hatch 410 for removal and cleaning. The fixed suction plenum 408 attaches to the duct 420 through an opening 417. The fixed suction plenum 408 may attach and may be affixed and sealed to the duct 420 by any suitable means such that suction in the duct 420 created by a fan 422 draws fumes into an inlet slot 405 in the end of the movable suction plenum 406. The movable suction plenum 406 may be slid in and out as indicated by the double-headed arrow 409. A movable sliding attachment such as a linear bearing may be employed to keep the movable suction plenum 406 in engagement with the fixed suction plenum 408. An appliance 402 is shown below the fixed suction plenum 408 and movable suction plenum 406. The appliance 402 shows a swing-out door 404 which, when opened, releases fumes that are drawn through the inlet slot 405 and passed as indicated by the curved arrows 429 into the movable suction plenum 406, through the opening 419 in the movable suction plenum, through the slot 418 in the fixed suction plenum, through the opening 417 and into the duct 420 passing eventually through the filter 412. The filter 412 may be a grease filter, a mesh filter, or a combination of both. The filter 412 may be held in place by a bracket indicated at and a bracket 423 each with openings or gaps to permit fumes to flow through the slot 423 as indicated. Note that the type of filter indicated admits the flow of fumes from a front face as shown and permits the fumes to flow out the ends, also as indicated by the arrows 425. If a baffle filter is used then the brackets 415 and 423 do not need openings or gaps.

It should be evident that the position of the inlet slot 405 may be changed at will by moving the movable suction plenum 406. The movable suction plenum 406 may be secured to the fixed suction plenum by any suitable means including fasteners, latches, or a mechanical drive (e.g., one driven by a motor—not shown). By moving the inlet slot 405, the suction point can be optimized for the most effective capture and containment of fumes emitted from the appliance 402. As in the foregoing embodiments, the position of the movable suction plenum 406 may be established by an installer or an operator that installs or changes the appliance 402. For example, a larger appliance 402 may be accommodated by moving the movable suction plenum 406 outwardly and to the right from the perspective of the drawing. while a smaller appliance 402 may be accommodated by moving the movable suction plenum inwardly to the left from the perspective of the drawing.

Seals 442 and 441 may be provided and attached to the movable suction plenum to provide a low friction glide and seal the air passage defined by the overlapping slot 418 and opening 419.

The fixed suction plenum 408 may be attached to exhaust modules such as those described with reference to FIG. 6 rather than attached to a modular wall duct. In such embodiments, the flow of fumes may be directed downwardly as in the embodiment of FIG. 6.

Figure 4B:
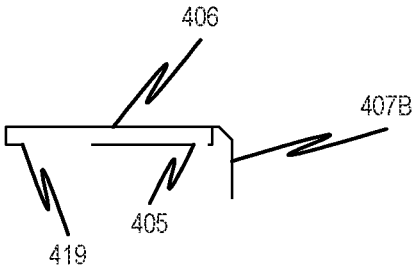
FIG. 4B shows an alternative flow guide for a movable suction plenum according to embodiments of the disclosed subject matter.

In embodiments, a forward flow guide such as indicated at 407A may be included at the end of the movable suction plenum to direct the suction field in a downward direction. In the embodiment of 407A, there is shown an angled plate mounted at the end of the movable suction plenum. In further embodiments, a flow guide may be vertical as indicated at 407B in FIG. 4B.

Figure 5A:
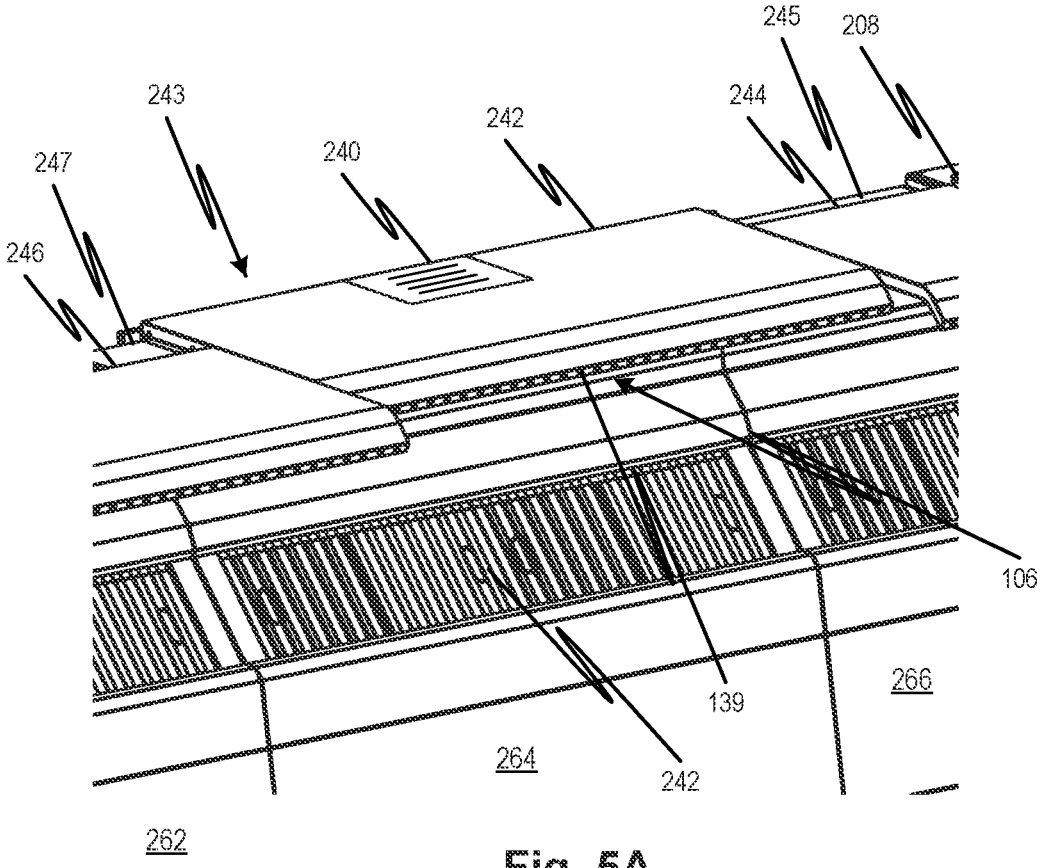
FIGS. 5A and 5B show two views of a module in the middle of a cooking line with a jet plenum in the retracted position and two adjacent modules with their jet plenums in more extended positions and also indicates the inlet grill in the top of the jet plenum which covers but does not inhibit flow through the fan inlet according to embodiments of the disclosed subject matter.
Figure 5B:
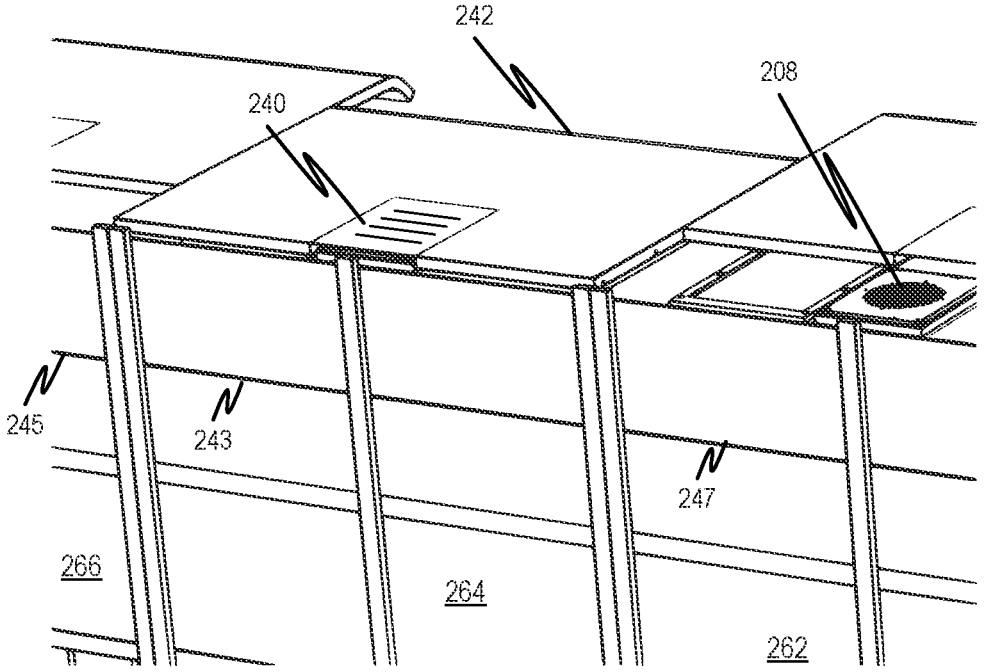

FIGS. 5A and 5B show respective back and front views of a single exhaust module 264 in the middle of a cooking line (between modules 262 and 266) with a jet plenum 242 in a retracted position and two adjacent modules 262 and 266 with their jet plenums 244 and 246 in more extended positions. Appliances are not shown, but the different positions may be established to suit the particular appliance below the jet plenums 246, 242, and 244 such that the jet plenum 242 in combination with an attached fan plenum (not visible in the drawing). Also indicated is the inlet grill 240 in outline in the top of the jet plenum portion that covers, without inhibiting flow through, the fan inlet. It will be observed that each exhaust module 262, 264, and 266 has its own fan plenum and jet plenum 245 and 247, fan plenum 243 associated with jet plenum 242 being obscured in the view of FIG. 5A by the jet plenum 242 but visible in FIG. 5B. The jet generator 106 and a hole 139 are also indicated as in FIG. 1A.

Figure 6:
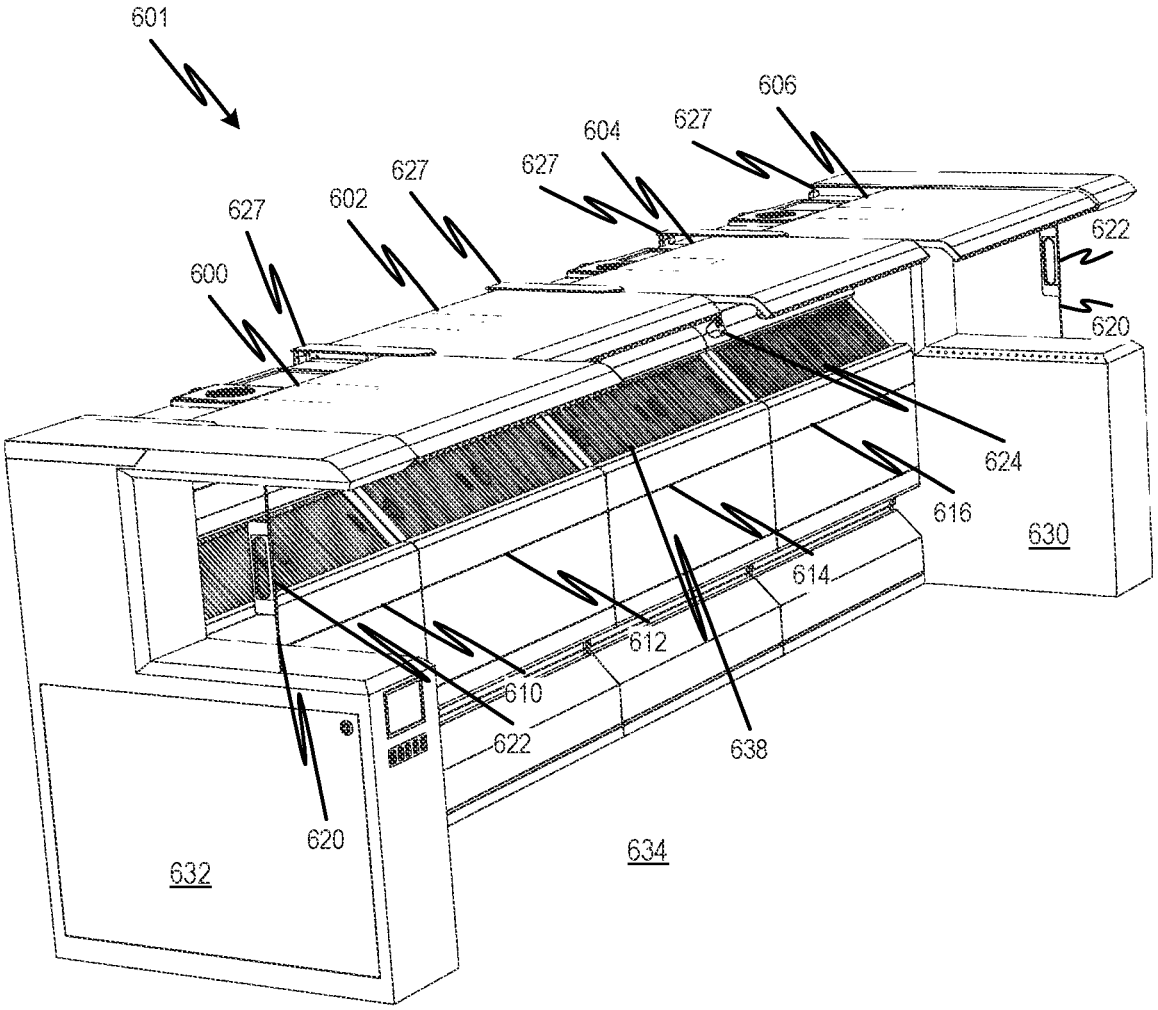
FIG. 6 shows a one-side cooking line of four modules with exhaust drawn through the floor from the sides according to embodiments of the disclosed subject matter.

FIG. 6 shows a system 601 including a single side cooking line of four modules with exhaust drawn through the floor from the sides. Side plenums 630 and 632 are connected to exhaust collars through a floor 634. Fumes are drawn through grease filters 638 of each module 610, 612, 614, and 616. The fumes may be conveyed through duct attachments between the modules 610, 612, 614, and 616 to the side plenums 630 and 632 or fumes may be conducted directly downwardly from each module 610, 612, 614, and 616 through collars connecting to ducts in the floor. As shown, the jet plenums 600, 602, 604, and 606 are in various positions respective of the appliance to be positioned beneath a respective one of them. Again each module 610, 612, 614, and 616 has a respective one of the jet plenums 600, 602, 604, and 606 connected thereto. In embodiments where fumes are drawn directly downwardly, the plenums 630 and 632 may serve as distribution cabinets for service supply such as valves for water for the fire safety system (note a fire suppression nozzle visible at 624), electrical connections, gas connections, etc. Side skirts 620 may be moved horizontally by means of handles 622 as in the embodiment of FIG. 1. In the present case, it can be seen that there are side skirts 620 on both ends of the cooking line.

Figure 7A:
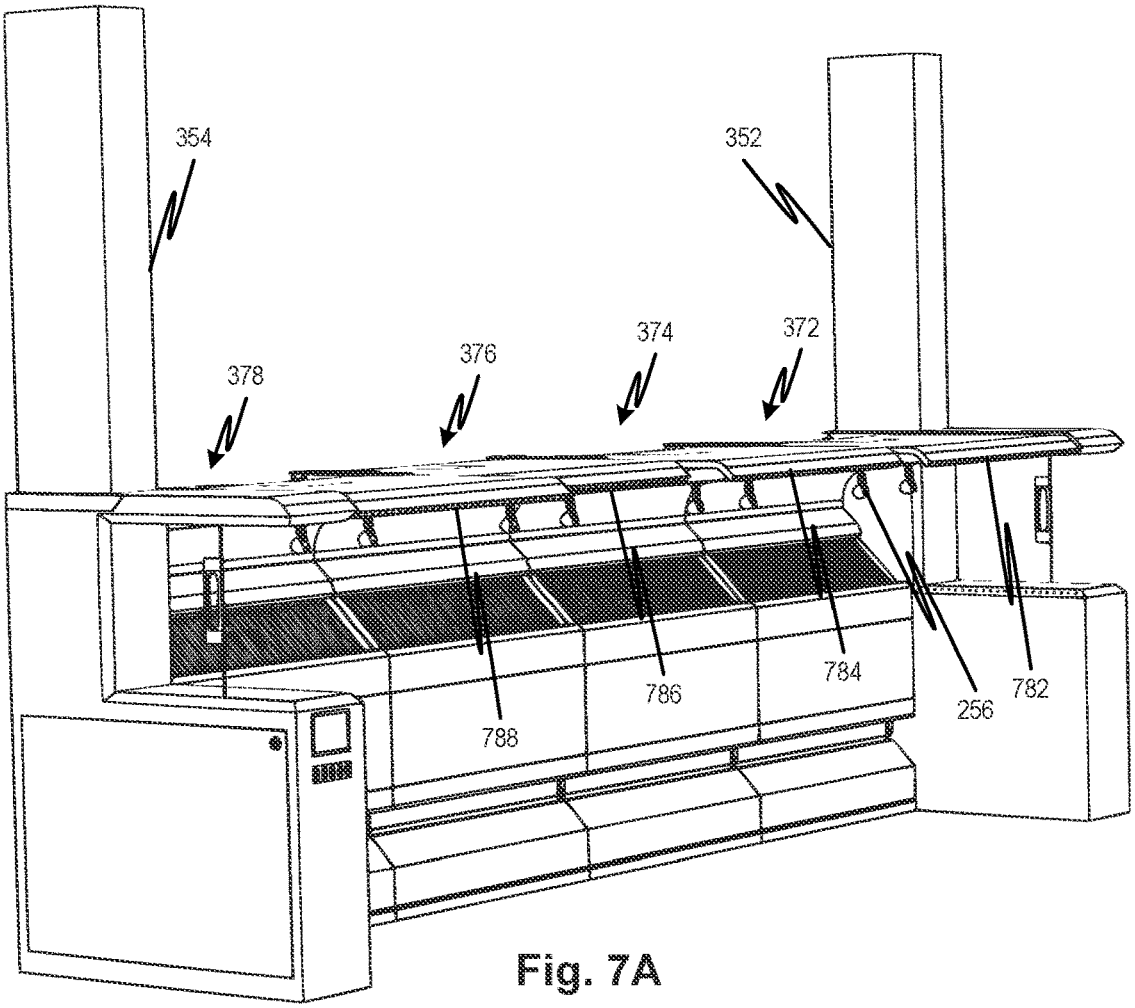
FIG. 7A shows a one-sided cooking line of four modules with ductwork to permit exhaust to be drawn through the ceiling according to embodiments of the disclosed subject matter.
Figure 7B:
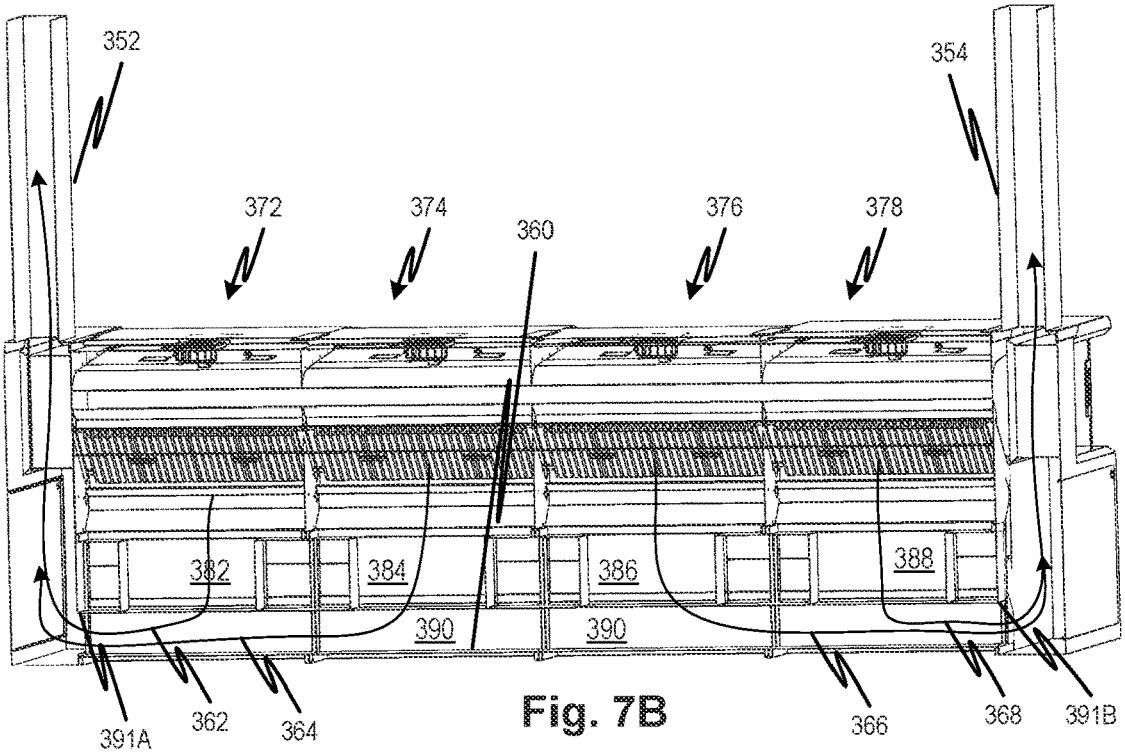
FIG. 7B shows a section through the back of the embodiment of FIG. 7A to show how fumes are conducted sideways through a duct to exhaust ducts that attach to the ceiling according to embodiments of the disclosed subject matter.

FIG. 7A shows a one-sided cooking line of four exhaust modules 372, 374, 376, and 378 with ductwork to permit exhaust to be drawn through the ceiling. Riser ducts 354 and 352 are connected to a lateral duct 360 at the back and shown in section in FIG. 7B. Each of the four exhaust modules 372, 374, 376, and 378 has a respective jet plenum 782, 784, 786, and 788. FIG. 7B shows a section through the back of the embodiment of FIG. 7A to show how fumes are conducted sideways through a duct to exhaust ducts that attach to the ceiling. Each curved arrow 362, 364, 366, 368 indicates flow through the filters of exhaust modules 372, 374, 376, and 378, respectively. Flow is conducted through a vertical duct section 382, 384, 386, and 388, respectively to the lateral duct 390 and out through an opening 391A leading to riser duct 352 and opening 391B leading to riser duct 354. One of several fire suppression nozzles is indicated at 256.

Figure 8:
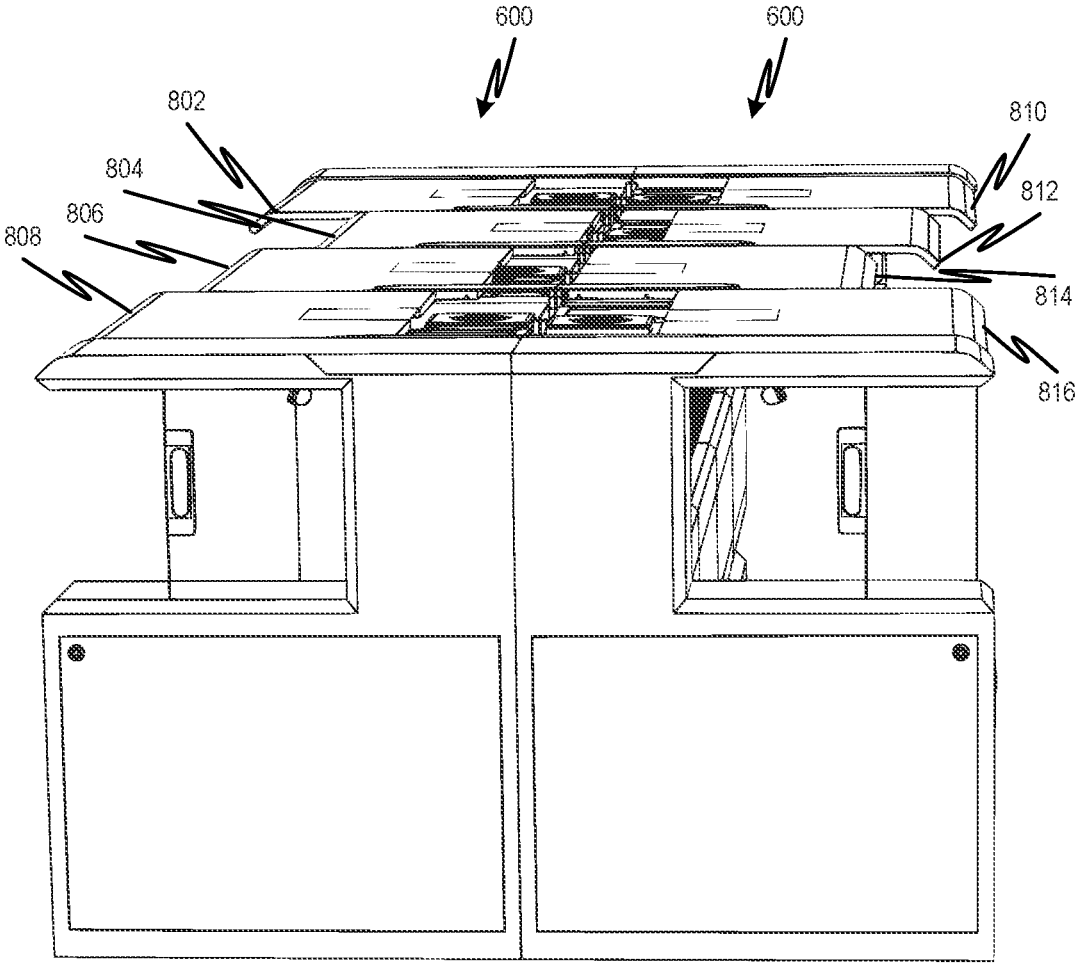
FIG. 8 shows a double-sided cooking line of eight modules (4 on each side) showing the varying positions of the jet plenums according to embodiments of the disclosed subject matter.

FIG. 8 shows a double-sided cooking line of eight modules (4 modules as 600 on each side facing away from each other) showing the varying positions of the jet plenums 802, 804, 806, 808, 810, 812, 814, 816. The individual modules are like those shown in FIG. 6 except that there are two sets of four arranged back-to-back.

Figure 9:
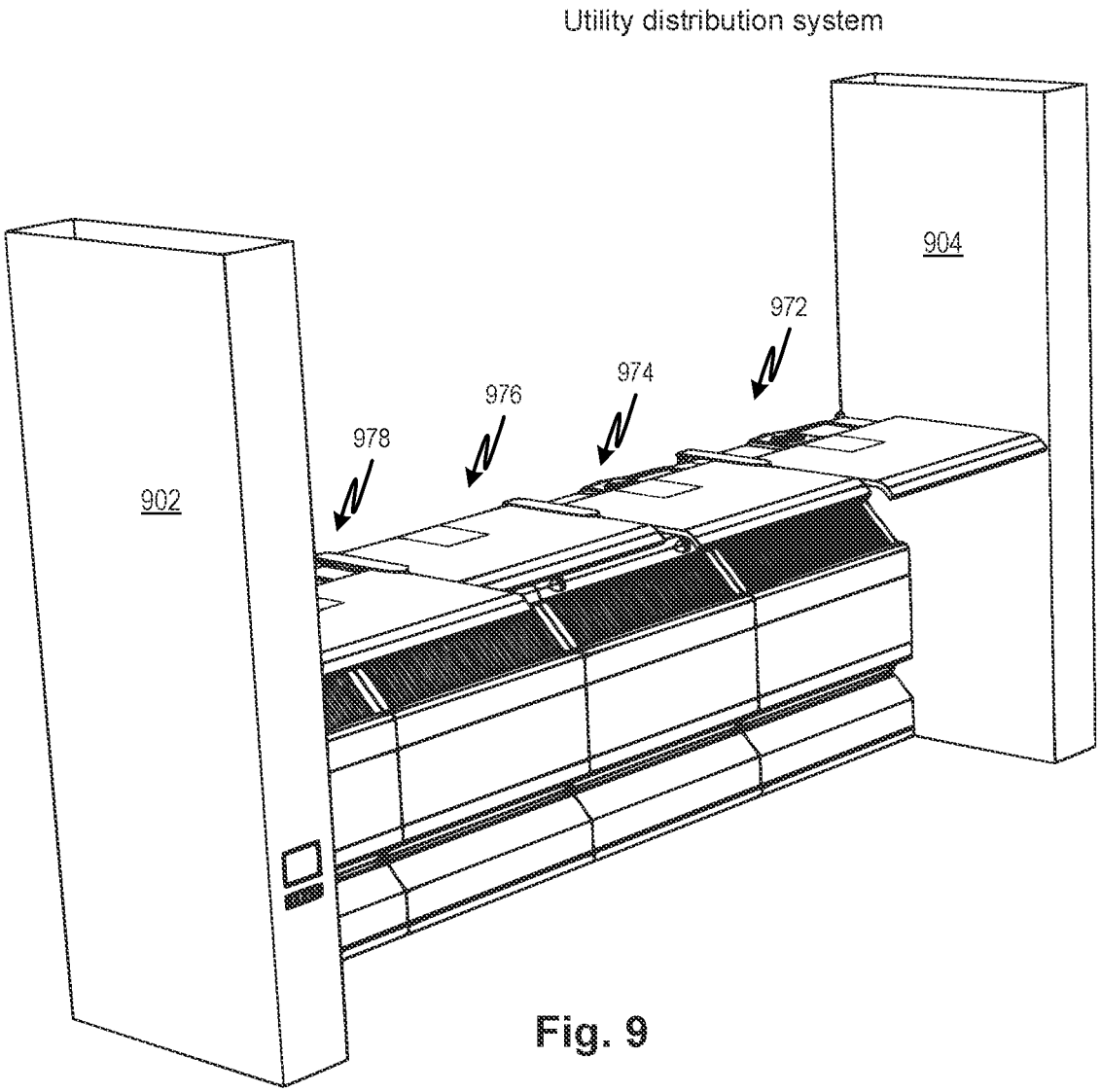
FIG. 9 shows an embodiment of four modules with exhaust and service supply housings located at the ends of the line according to embodiments of the disclosed subject matter.
Figure 10:
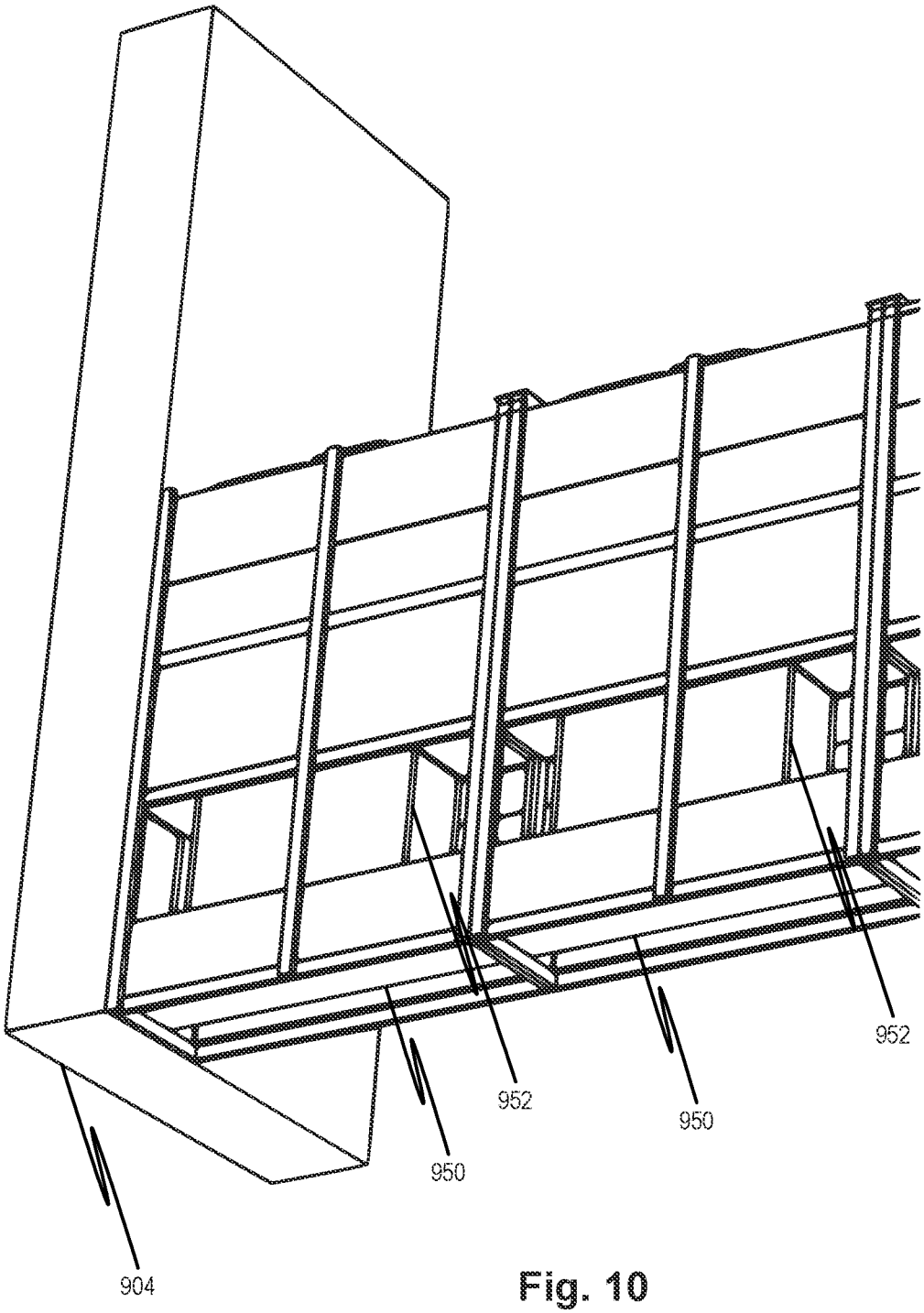
FIG. 10 shows a bottom view of the service supply housing embodiment of FIG. 9 to show the ducting that draws fumes from the adjacent modules toward the service supply housings at each end according to embodiments of the disclosed subject matter.

FIG. 9 shows an embodiment of four modules 972, 974, 976, and 978 with exhaust and service supply housings located at the ends of the line. The exhaust and service supply housings 902 and 904 house service conduits such as pipes that deliver fire suppression liquid such as water, potable water supply, electrical supply, natural gas piping, data signal lines, as well as ducting for exhaust. Fumes may be drawn as indicated in FIG. 10 which shows a bottom view of the service supply housing embodiment of FIG. 9 to show the ducting that draws fumes from the adjacent modules toward the service supply housings at each end. The arrangement is generally the same as shown in FIG. 7B wherein each module's filter plenum is connected by a vertical duct 952 (only two modules are shown for clarity but there can be any number of adjacent modules) to a lateral duct 950 that attaches at both ends (only one end shown here) to a duct within the service supply housing 904.

Figure 11A:
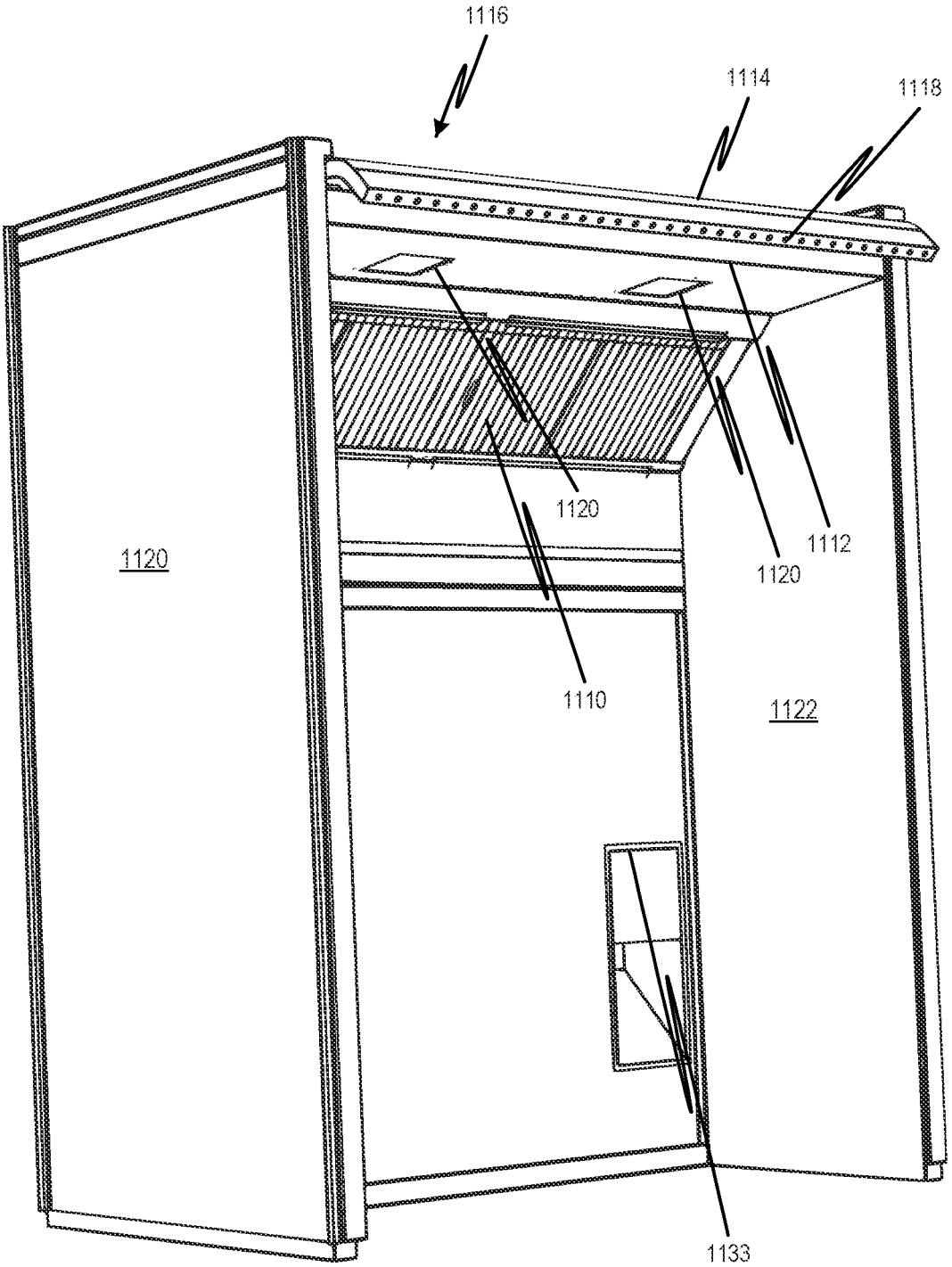
FIG. 11A shows a perspective view of a single exhaust module forming a cabinet with side panels and a movable jet plenum according to embodiments of the disclosed subject matter.
Figure 11B:
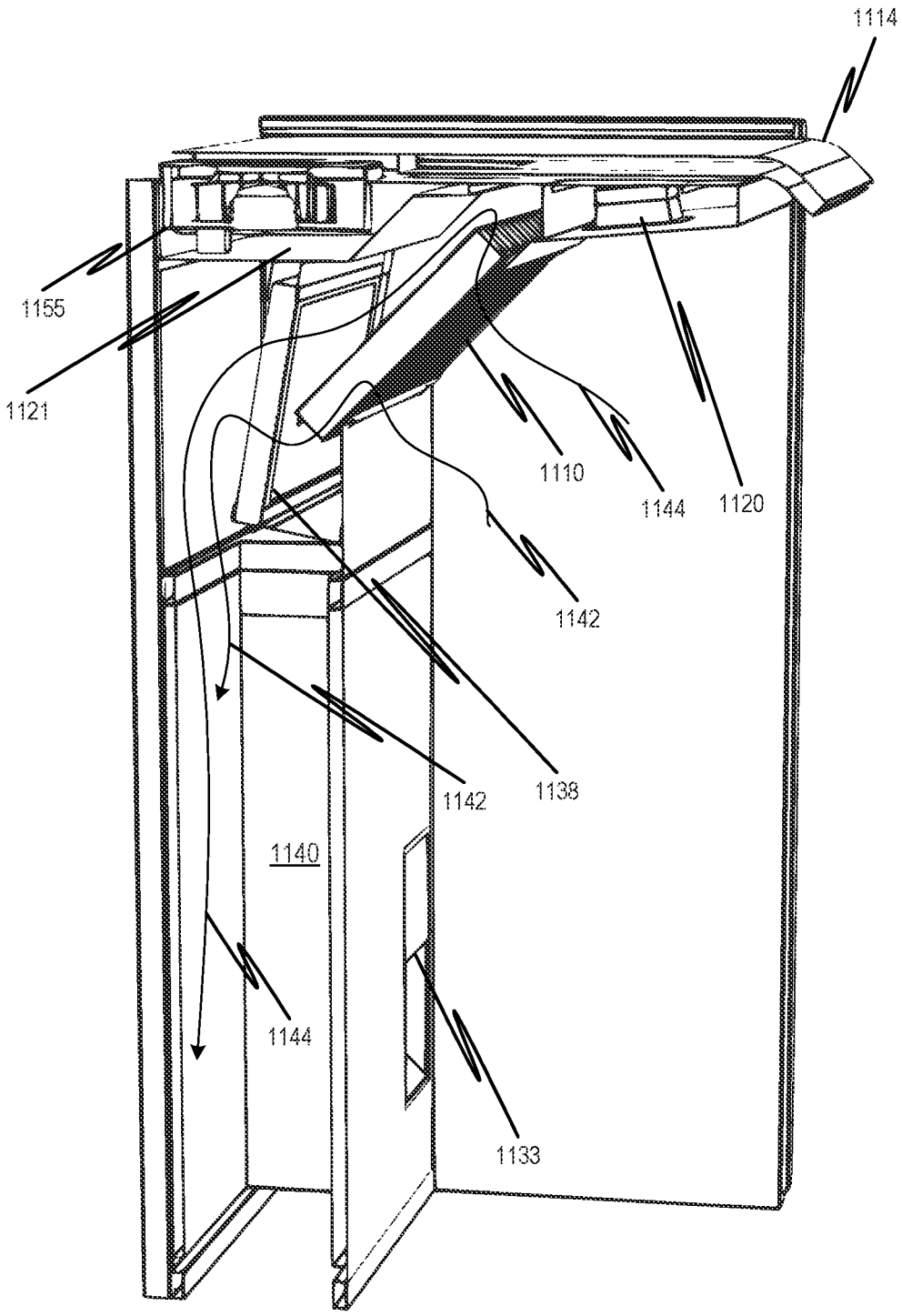
FIG. 11B shows a cutaway view of the single exhaust module forming a cabinet with side panels and a movable jet plenum of FIG. 11A according to embodiments of the disclosed subject matter.

FIG. 11A shows a perspective view of a single exhaust module forming a cabinet 1116 with side panels 1120 and 1122 and a movable jet plenum 1114 supported movably on a fixed fan plenum 1112, which may be as the fan plenums (e.g., 119) described above. The movable jet plenum 1114 has at its end a series of holes 1118 or an elongate slit (not illustrated) to generate jets, as the embodiments described above. Lighting fixtures may be positioned on the fixed fan plenum housing as indicated at 1120. An electrical cable pass-through is shown at 1133. Fumes from appliances are drawn through filters 1110 and conducted downwardly or upwardly depending on the configuration. As shown in FIG. 11B, the exhaust module 1116 has a downwardly directed duct 1140 through which fumes pass following arrows 1142 and 1144. Fumes pass through a first stage grease filter 1110 and then through a second stage filter 1138 such as a mesh-type filter. As above, the first stage grease filter 110 is of a type in which fumes enter at a face thereof and exit at ends thereof. The jet fan 1155 that pressurizes the fan plenum 1121 is visible in the fan plenum. It will be observed that the fan plenum 1121 has a shorter housing than the configuration of FIG. 1A but there is still sufficient space for the slot to feed the jet plenum opening to pressurize the latter.

Figure 12A:
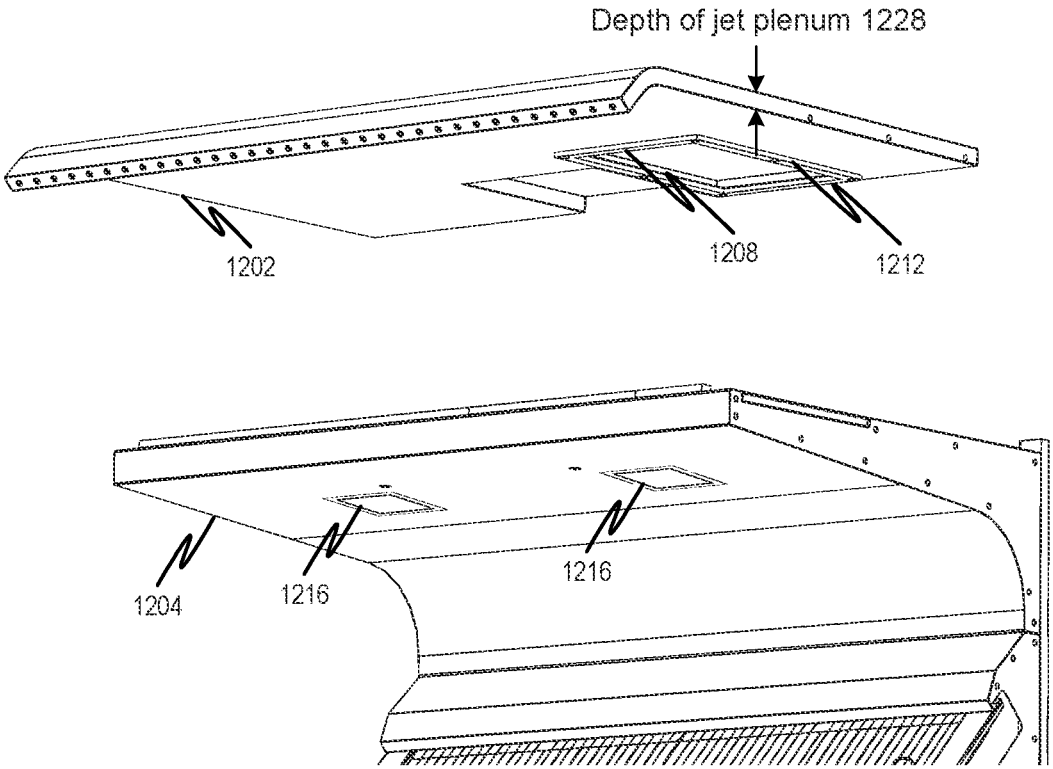
FIGS. 12A and 12B show a fan plenum and a jet plenum for an individual exhaust module separated from a remainder of the exhaust module from two different perspectives according to embodiments of the disclosed subject matter.
Figure 12B:
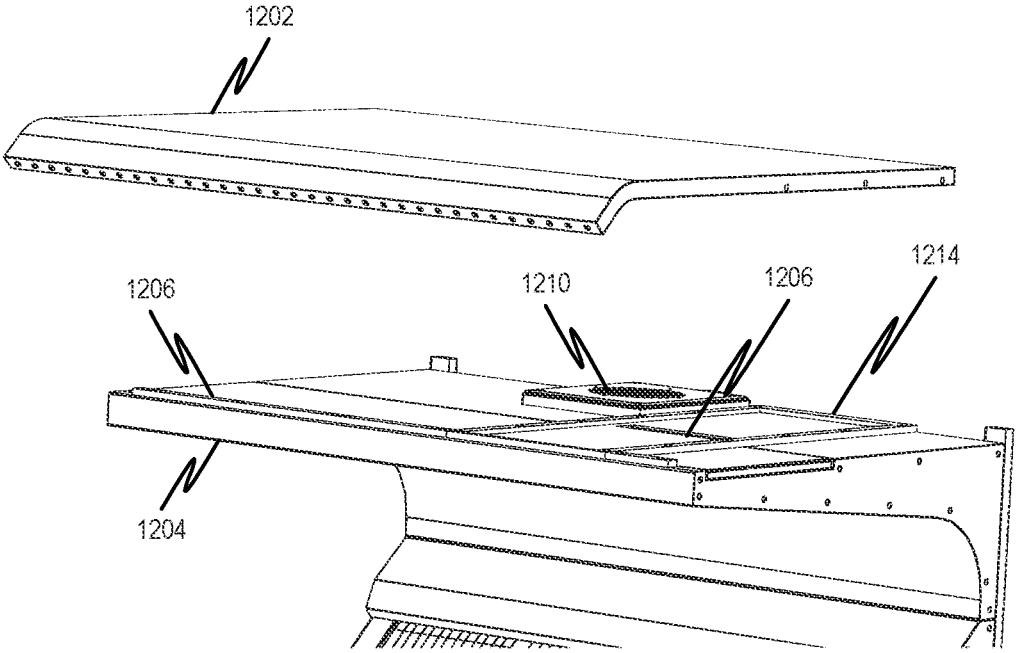
Figure 12C:
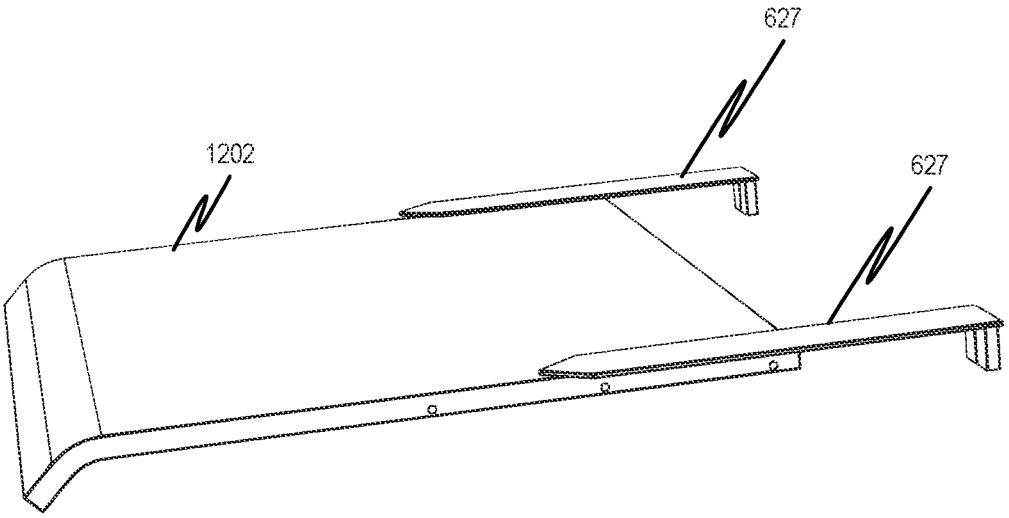
FIG. 12C shows brackets to hold the jet plenum against the fan plenum according to embodiments of the disclosed subject matter.

FIGS. 12A and 12B show a fan plenum and a jet plenum for an individual exhaust module separated from a remainder of the exhaust module from two different perspectives. A jet plenum 1202 is the same configuration shown in FIG. 1A and others. It will be observed that the overall shape is one of uniform depth which facilitates its ability to slide with respect to the fan plenum 1204. The jet plenum 1202 rests on top of low friction glides that help to seal the air passage from the slot 1206 in the fan plenum 1204 and the opening 1208 in the jet plenum 1202. The fan air inlet 1210 is visible in FIG. 12B. It can be seen that the opening 1208 is surrounded by a rectangular fence 1212 that fits within a rectangular fence 1214 on the fan plenum to form a seal between the opening 1208 and the slot 1206. Note that in alternative embodiments, the larger opening like that indicated at 1208 may be located on the fan plenum 1204 and the smaller slot 1206 may be located on the jet plenum. Note also that the uniform depth of the jet plenum 1228 facilitates the movement of the jet plenum 1202 with respect to the fan plenum 1204. The fan plenum may be provided with U-shaped brackets to hold the jet plenum 1202 against the fan plenum 1204. See for example the brackets indicated at 627 in FIG. 6 and at 627 in FIG. 12C. Other types of clamps or fasteners may be used especially adapted for configurations in which the jet plenum 1202 is moved infrequently such as when an installer installs a new appliance. Lighting fixtures 1216 are visible in the bottom of the fan plenum 1204.

In slot any and of opening the foregoing embodiments, the jet plenum and fan plenum may be replaced by fixed hood portions such that what replaces the fan plenum is a fixed mini-hood that is retractable and extendable and no jet is generated. For example, according to such further embodiments, the disclosed subject matter includes an exhaust system with a fixed support with an extendable hood portion configured to cover a cooking appliance. The extendable hood portion is movably attached to the fixed support. The fixed support may have a motorized or manual actuator to permit an operator or hood or appliance installer to move the hood portion to a desired position optimized for the appliance or conditions in the kitchen.

According to embodiments, the disclosed subject matter includes an exhaust device with a fan plenum having a fan and a jet plenum having a generally planar shape with one or more jet openings on a distal edge thereof configured to create a planar jet. The jet plenum is movably attached at a proximal end thereof to the fan plenum to permit sliding movement of the jet plenum relative to the fan plenum. The fan plenum and the jet plenum each have a respective flow-transfer opening that overlaps the opening of the other, the respective openings being shaped and arranged to remain overlapped in all positions to which the jet plenum is moved relative to the fan plenum such that an interior of the fan plenum and the jet plenum remain in fluid communication to allow air to flow from the fan to flow from the fan plenum to the jet plenum to the one or more openings and form a jet through the one or more jet openings.

In variations, the foregoing embodiments may be modified to form new embodiments that include an exhaust intake located beneath the fan plenum arranged to be covered by the fan plenum and forming a continuous flow guide from a distal end of the jet plenum leading to the exhaust intake.

In variations, the foregoing embodiments may be modified to form new embodiments in which one of the fan plenum and the jet plenum has a larger flow transfer opening than the other of the fan plenum and the jet plenum.

In variations, the foregoing embodiments may be modified to form new embodiments in which the flow transfer openings are interfaced with each other by a circumnavigating seal that retains air flowing from the fan plenum to the jet plenum.

In variations, the foregoing embodiments may be modified to form new embodiments in which the fan has an intake at a top of the fan plenum which is covered by a louvered grill of the jet plenum when the jet plenum is in a fully retracted position thereby permitting air to flow into the intake.

In variations, the foregoing embodiments may be modified to form new embodiments that include a motor drive connected to the jet plenum.

In variations, the foregoing embodiments may be modified to form new embodiments that include a controller connected to control the motor drive to extend and retract the jet plenum responsively to a detected cooking state of an appliance.

In variations, the foregoing embodiments may be modified to form new embodiments in which the cooking state of the appliance is applied by a signal from a communication system connected to the appliance.

According to embodiments, the disclosed subject matter includes an exhaust system with two or more exhaust modules each having a movable hood portion, each movable hood portion forming a generally flat horizontal flow guide. Each of the two or more exhaust modules movable hood portions being independently movable relative to other movable hood portions. An exhaust inlet located below the movable hood portion, the exhaust inlet being located to permit a cooking appliance to be positioned therebelow.

According to embodiments, the disclosed subject matter includes a method of exhausting fumes from a source of fumes. The method includes providing a fan plenum with a fan, providing a jet plenum having one or more jet openings on a distal end thereof, the one or more jet openings being configured to generate a planar jet, sliding the jet plenum relative to the fan plenum while continuously maintaining a fluid connection between the jet plenum and the fan plenum, and operating the fan to generate a flow of air in the fan plenum that flows through the fluid connection into the jet plenum, and generating a planar jet at the distal end of the jet plenum.

In variations, the foregoing embodiments may be modified to form new embodiments that include providing the source of fumes below the jet plenum, wherein the source of fumes has a distal boundary that extends horizontally beyond the distal end of the jet plenum, and the sliding the jet plenum causes the distal end of the jet plenum to reach a position from which the initial direction of the planar jet extends at least to the distal boundary of the source of fumes.

In variations, the foregoing embodiments may be modified to form new embodiments where the sliding the jet plenum is controlled based on a cooking state of cooking appliance positioned below the jet plenum.

In variations, the foregoing embodiments may be modified to form new embodiments that include providing an exhaust intake below the jet plenum, and exhausting the fumes through the exhaust intake.

In variations, the foregoing embodiments may be modified to form new embodiments where the one or more jet openings point toward the source of fumes.

In variations, the foregoing embodiments may be modified to form new embodiments where the planar jet traps the fumes below the jet plenum.

In variations, the foregoing embodiments may be modified to form new embodiments that include providing a second jet plenum below the jet plenum, the second jet plenum having one or more jet openings pointed above a horizontal direction.

In variations, the foregoing embodiments may be modified to form new embodiments where the one or more jet openings of the second jet plenum generate a second planar jet that intersects the planar jet generated at the distal end of the jet plenum.

In variations, the foregoing embodiments may be modified to form new embodiments where the planar jet and the second planar jet together prevent fumes from the fume source from escaping from below the jet plenum.

According to embodiments, the disclosed subject matter includes a method of exhausting fumes from a source of fumes. The method includes providing a fixed suction plenum that is stationary and generates or conveys suction, providing a movable suction plenum having one or more suction inlets on a distal end thereof, the one or more suction inlets being configured to suck in the exhaust fumes, sliding the movable suction plenum relative to the fan plenum while continuously maintaining a fluid connection between the fixed suction plenum and the movable suction plenum, and operating a fan to generate a flow of air in the fixed suction plenum that flows through the fluid connection and the movable suction plenum.

In variations, the foregoing embodiments may be modified to form new embodiments that include providing the source of fumes below the movable suction plenum, wherein the source of fumes has a distal boundary that extends horizontally beyond the distal end of the jet plenum, and the sliding the movable suction plenum causes the distal end of the movable suction plenum to reach a position from which all exhaust fumes emitted by the source of fumes are captured.

In variations, the foregoing embodiments may be modified to form new embodiments where the sliding the movable suction plenum is controlled based on a cooking state of cooking appliance.

In variations, the foregoing embodiments may be modified to form new embodiments in which each hood portion is supported by a fixed portion having lighting panels positioned and oriented to direct light downwardly toward a cooking appliance beneath it. In variations, the foregoing embodiments may be modified to form new embodiments in which each exhaust module movable hood portion is movable relative to the other to permit cooking appliances of different size and construction to be placed beneath them. In variations, the foregoing embodiments may be modified to form new embodiments that include a motor drive connected to the movable hood portion. In variations, the foregoing embodiments may be modified to form new embodiments that include a controller connected to control the motor drive to extend and retract the movable hood portion responsively to a detected cooking state of an appliance. In variations, the foregoing embodiments may be modified to form new embodiments in which the cooking state of the appliance is applied by a signal from a communication system connected to the appliance. In variations, the foregoing embodiments may be modified to form new embodiments in which each hood portion is supported by a fixed portion, the movable hood portion having lighting panels positioned and oriented to direct light downwardly toward a cooking appliance beneath it.

It is, thus, apparent that there is provided, in accordance with the present disclosure, a compact exhaust system. Many alternatives, modifications, and variations are enabled by the present disclosure. Features of the disclosed embodiments can be combined, rearranged, omitted, etc., within the scope of the invention to produce additional embodiments. Furthermore, certain features may sometimes be used to advantage without a corresponding use of other features. Accordingly, Applicants intend to embrace all such alternatives, modifications, equivalents, and variations that are within the spirit and scope of the present invention.

What is claimed is:

1. An exhaust device, comprising:

a fan plenum with a fan;

a jet plenum having one or more jet openings on a distal end thereof configured to create a planar jet;

the jet plenum being movably attached at a proximal end thereof to the fan plenum to permit sliding movement of the jet plenum relative to the fan plenum;

the fan plenum and the jet plenum each having a respective flow-transfer opening that overlaps the opening of the other, the respective openings being shaped and arranged to remain overlapped in all positions to which the jet plenum is moved relative to the fan plenum such that an interior of the fan plenum and the jet plenum remain in fluid communication to allow air to flow from the fan to the jet plenum to the one or more openings and form a jet through the one or more jet openings; and the fan having an intake at a top of the fan plenum which is covered by a louvered grill of the jet plenum when the jet plenum is in a fully retracted position thereby permitting air to flow into the intake.

2. The device of claim 1, further comprising:

at least one end panel that includes a second jet plenum, wherein the second jet plenum includes one or more jet openings on a top end of the at least one end panel, the one or more jet openings on the top end are configured to generate a second planar jet directed toward the jet plenum.

3. The device of claim 2, wherein the second planar jet is aimed diagonally upward.

4. The device of claim 1, wherein the jet plenum has a substantially planar shape.

5. The device of claim 1, further comprising an exhaust intake located beneath the fan plenum arranged to be covered by the fan plenum and forming a continuous flow guide from a distal end of the jet plenum leading to the exhaust intake.

6. The device of claim 1, wherein one of the fan plenum and the jet plenum has a larger flow transfer opening than the other of the fan plenum and the jet plenum.

7. The device of claim 1, wherein the flow transfer openings are interfaced with each other by a circumnavigating seal that retains air flowing from the fan plenum to the jet plenum.

8. The device of claim 1, further comprising a motor drive connected to the jet plenum.

9. The device of claim 8, further comprising a controller connected to control the motor drive to extend and retract the jet plenum responsively to a detected cooking state of an appliance.

10. The device of claim 9, wherein the cooking state of the appliance is applied by a signal from a communication system connected to the appliance.

11. A method of exhausting fumes from a fume source, the method comprising:

providing a fan plenum with a fan;

providing a jet plenum having one or more jet openings on a distal end thereof, the one or more jet openings being configured to generate a planar jet;

providing the fan with a fan intake at a top of the fan plenum, the fan intake being covered by a louvered grill of the jet plenum when the jet plenum is in a fully retracted position thereby permitting air to flow into the fan intake;

sliding the jet plenum relative to the fan plenum while continuously maintaining a fluid connection between the jet plenum and the fan plenum; and operating the fan to generate a flow of air in the fan plenum that flows through the fluid connection into the jet plenum; and generating a planar jet at the distal end of the jet plenum.

12. The method according to claim 11, further comprising:

providing the source of fumes below the jet plenum, wherein the source of fumes has a distal boundary that extends horizontally beyond the distal end of the jet plenum, and the sliding the jet plenum causes the distal end of the jet plenum to reach a position from which an initial direction of the planar jet extends at least to the distal boundary of the source of fumes.

13. The method according to claim 11, wherein the sliding the jet plenum is controlled based on a cooking state of cooking appliance positioned below the jet plenum.

14. The method according to claim 11, further comprising:

providing an exhaust intake below the jet plenum; and exhausting the fumes through the exhaust intake.

15. The method according to claim 11, wherein the one or more jet openings point toward the source of fumes.

16. The method according to claim 11, wherein the planar jet traps the fumes below the jet plenum.

17. The method according to claim 11, further comprising:

providing a second jet plenum below the jet plenum, the second jet plenum having one or more jet openings pointed above a horizontal direction.

18. The method according to claim 17, wherein the one or more jet openings of the second jet plenum generate a second planar jet that intersects the planar jet generated at the distal end of the jet plenum.

19. The method according to claim 18, wherein the planar jet and the second planar jet together prevent fumes from the fume source from escaping from below the jet plenum.

* * * * *